United States Patent [19]

Smith

[11] Patent Number: 4,565,294

[45] Date of Patent: Jan. 21, 1986

[54] TAMPER EVIDENT CONTAINER SHROUD

[76] Inventor: Moe S. Smith, 320 Ridelle Ave., Suite 802, Toronto, Ontario, Canada, M6B 4B4

[21] Appl. No.: 704,971

[22] Filed: Feb. 15, 1985

Related U.S. Application Data

[63] Continuation-in-part of Ser. No. 583,244, Feb. 23, 1984, abandoned, which is a continuation-in-part of Ser. No. 504,211, Jun. 13, 1983, abandoned.

[51] Int. Cl.[4] ..... B65D 41/46

[52] U.S. Cl. ..... 215/251; 215/256; 220/257; 220/270

[58] Field of Search ..... 215/256, 251, 277; 220/257, 270

[56] References Cited

U.S. PATENT DOCUMENTS

| | | | |
|---|---|---|---|
| 3,037,672 | 6/1962 | Gach | 220/270 X |
| 3,474,930 | 10/1969 | Lerner | 220/270 |
| 3,650,428 | 3/1972 | Miller | 215/256 |
| 4,305,517 | 12/1981 | Dennis | 215/256 |
| 4,307,821 | 12/1981 | McIntosh | 215/256 X |
| 4,322,010 | 3/1982 | Curry | 215/256 |

*Primary Examiner*—Donald F. Norton

*Attorney, Agent, or Firm*—Ridout & Maybee

[57] ABSTRACT

The present invention relates generally to a tamper evident shroud for application to a moulded plastic or glass container having a closure and a protruding peripheral ridge of generally circular corss-section. The shroud has a cup-shaped body portion and an annular rim portion, the two portions being joined by a notch-line of weakness. The rim portion has an inwardly projecting peripheral ridge which engages the peripheral ridge of the container to resist removal of the shroud. The notch-line of weakness is designed to rupture upon unauthorized removal of the shroud, thereby providing visual evidence of tampering. To accommodate intentional opening of the container, the annular rim portion is adapted to be torn away from the body portion along the rupturable notch-line.

19 Claims, 7 Drawing Figures

TAMPER EVIDENT CONTAINER SHROUD

This application is a continuation-in-part of my now abandoned copending application, Ser. No. 06/583,244, filed Feb. 23, 1984, which is a continuation-in-part of my now-abandoned application No. 06/504,211, filed June 13, 1983, which applications are hereby incorporated by reference.

FIELD OF THE INVENTION

This invention relates generally to the field of tamper evident containers, and is particularly concerned with the provision of a tamper evident container shroud of the type adapted for application to a moulded glass or plastic container so as to surround the underlying container closure. Shrouds in accordance with the invention are especially suitable for use in association with food or medicine containers, where it is important to know whether the contents may have been tampered with.

BACKGROUND AND SUMMARY OF THE INVENTION

Although tamper evident shrouds have been previously proposed, they have not found wide application in the packaging industry because of their inherent complexity of design, difficulty of manufacturing, and high cost of production. The high cost of modifying or producing new containers suitable for use in combination with these known closure devices has also presented a barrier to their widespread acceptance.

While known tamper evident shrouds are designed to reveal unintentional or unauthorized removal of the closure from the container, they are not generally adapted to reveal unauthorized use of a pump or a pop-up squirting nozzle incorporated into the closure, where such device can be used without removal of the closure from the container.

One known form of tamper evident container shroud is described in U.S. Pat. No. 3,037,672 (Gach). However, the shroud disclosed in this patent is usable only with aerosol cans or other metal containers which provide a sharp shoulder or other projection of generally rectangular or square cross-section to be gripped by the engaging rim of the shroud, which rim itself is of generally rectangular cross-section with a flat upper engaging surface oriented parallel to the interacting shoulder of the container in the engaged configuration. Such a shroud is not adaptable to modern plastic or glass containers formed, for example, by blow moulding techniques, which lack such sharp shoulders. Moreover, the Gach shroud can only be moulded, because of the geometry of its engaging rim, with mould die members capable of a side action, in addition to the axial movement of the male and female die members. This increases the costs of moulding such a shroud to unacceptable levels.

Another known form of tamper evident container shroud is described in U.S. Pat. No. 3,474,930 (Lerner). This shroud is, like the Gach shroud, only of practical utility when used with metal cans or other containers having a sharp shoulder or other projection of generally rectangular or square cross-section to be gripped by the engaging rim of the shroud, which rim itself has a planar upper engaging surface oriented generally parallel to the interacting shoulder of the container in the engaged configuration, such that minimal frictional interference between the shoulder and the rim is sufficient to effectively hold the shroud on the container. When used with the previously described modern forms of moulded glass or plastic containers having shoulders or projections of more rounded geometry, the geometry of the Lerner shroud fails to provide sufficient frictional interference to prevent undetected removal. Moreover, if the degree of interference between the shoulder and the rim is increased by increasing the physical overlap of these two components, the resilience of the shroud material will be insufficient to allow, on installation of the shroud, movement of the rim past the shoulder without causing fracturing of the tamper evident means. Additionally, the Lerner shroud illustrated in U.S. Pat. No. 3,474,930, cannot, in view of the generally planar perpendicular geometry of the shroud rim, be made without the use of die elements capable of a side action moulding operation.

It is, therefore, an object of the present invention to provide a simple and inexpensive tamper evident container shroud which can be made in a simple moulding operation by moving the male and female die members axially without side action of the die members. This eliminates the difficulty and expense of moulding which is inherent in a side action type of moulding.

Another object of this invention is to provide a tamper evident shroud which can be used in combination with pre-existing moulded glass or plastic containers with only minor inexpensive modifications to the moulds for these containers. Typically, the neck section of such existing containers can be modified by providing a smooth groove around the mouth of the container so as to present a peripheral ridge for engagement by the shroud in a manner more fully described below.

Another object of this invention is to provide a shroud constructed of an ultra high-flow low-density polyethylene resin, which shroud, when heated, overcomes the resiliency problems encountered in the installation of previously known designs of tamper evident container shrouds.

It is a further object of the invention to provide a container shroud for use with moulded plastic or glass containers which will, when unintentional or unauthorized removal of the shroud is attempted, provide clear visual evidence of such tampering. Similarly, an attempt to remove the container closure without removal of the shroud will provide visual evidence of such an attempt.

A still further object of a preferred embodiment of the invention is to provide a container shroud for use with moulded plastic or glass containers which shroud incorporates a tear-off strip that can be peeled cleanly from the shroud along a notch-line of weakness to facilitate opening of the container by the intended consumer, the remaining cup-shaped portion of the shroud being replaceable over the closure, and being dimensioned to serve as a dust cover and/or measuring cup for the container contents.

A tamper evident container shroud in accordance with the invention is designed for use with a moulded glass or plastic container having a mouth with an outwardly projecting peripheral ridge and a closure for the mouth. The shroud is moulded of ultra high-flow low-density polyethylene resin and can, upon heating, be pushed onto the container over the closure to encase the closure, the shroud having a cup-shaped body portion and a resilient rim portion of generally circular cross-sections which can be pushed over the peripheral ridge of the container with the body portion free of contact with the closure located within the shroud, the shroud having a relatively weak portion between its body and rim portions, the resistance of the weak portion to tearing being less than the resistance of the rim portion to being pulled back, after cooling, over the peripheral ridge of the container, whereby access to the closure cannot be had without visibly tearing the weak portion of the shroud.

The invention further relates to, in combination, a moulded plastic or glass container having a mouth with an outwardly protruding peripheral ridge, a closure for the mouth and a shroud having a cup-shaped body portion within which the closure is encased, the shroud having an outwardly stepped rim portion having an inwardly protruding peripheral ridge of generally circular cross-section extending under the ridge of the container and holding the shroud on the container with the cup-shaped portion free of contact with the closure, the shroud being moulded of ultra high-flow low-density polyethylene resin, with a notch-line of weakness between the rim portion and cup-shaped portion, the resistance of the line of weakness to tearing being less than the resistance of the ridge of the rim portion to being pulled over the ridge of the container if the cup-shaped portion is pulled to expose the closure whereby access to the closure cannot be had without visibly tearing the shroud at the line of weakness, thereby providing evidence of tampering. The rim portion also constitutes a tear-off strip that can be peeled off the cup-shaped body portion along the notch-line of weakness, whereby the cup-shaped body portion can serve as a measuring cup. Where the cup-shaped body portion of the shroud is impervious to dust, and the rim portion is removed as aforesaid, the cup-shaped body portion can also serve as a dust cover.

Furthermore, the rim portion of the shroud may be fitted with an external flexible tab having a free end connected by a rupturable web to the rim portion, the tab having an end fixed to the rim portion adjacent a transverse notch-line of weakness of the rim portion, the inwardly protruding peripheral ridge of the rim portion being interrupted at the transverse notch-line to facilitate rupture of the rim portion along the notch-line when the tab is pulled to peel the rim portion off the cup-shaped body portion.

BRIEF DESCRIPTION OF THE DRAWINGS

Several container shrouds in accordance with the invention will now be described in detail by way of example, with reference to the accompanying drawings in which.

DESCRIPTION OF THE PREFERRED EMBODIMENT

Figure 1:
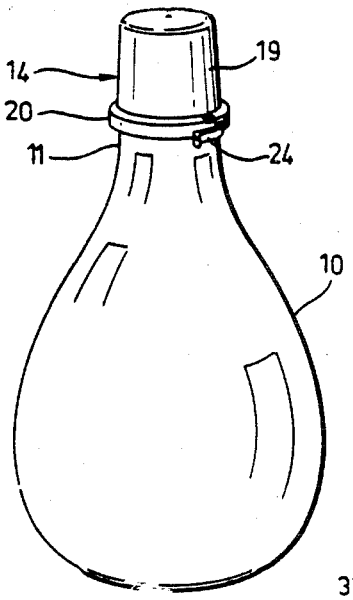
FIG. 1 is a perspective view of a first embodiment of a container shroud according to the invention in place on a container.

Referring to the drawings, wherein like numerals are used to designate similar parts throughout the various views, there is shown an integral container 10, having a closure 13 encased by a tamper evident shroud generally designated by the reference numeral 14, the shroud 14 having been, after heating as more fully described below, pushed onto the container 10. The shroud 14 comprises a cup-shaped body portion 19 and a resilient, outwardly stepped rim portion 20 engaging the underside of a container ridge 15 by means of an inwardly protruding peripheral ridge 22 of generally circular cross-section on the rim portion 20. The shroud is in this manner held on the container, free of contact with the closure 13.

Referring more particularly to FIGS. 1–4, the container 10, moulded from glass or plastic resins, has a neck region 11, which terminates at its upper end in a mouth 12, surrounded by the outwardly protruding peripheral ridge 15. The ridge 15 shown is defined at its lower edge by a groove 16 circumscribing the neck 11, although other arrangements such as a peripheral ridge which protrudes beyond an ungrooved neck surface (see FIGS. 5 and 6), are possible. The grooved neck arrangement is preferred, as it is a simple matter to provide such a groove in the mould dies of existing designs of glass or plastic containers. In particular, this arrangement is especially suited for blow moulded container dies, where sharp angles and close tolerance should be avoided. All that is required is that the groove 16 be sufficiently deep and well-defined so as to frictionally engage at least the upper surface of peripheral ridge 22.

The container mouth 12 is adapted to receive the closure 13 by the provision of an upwardly extending annular projection 17 at the outer edge of the mouth opening. The projection 17 is externally threaded to receive the internally threaded closure 13, thereby holding the closure 13 in place over the mouth 12.

Figure 2:
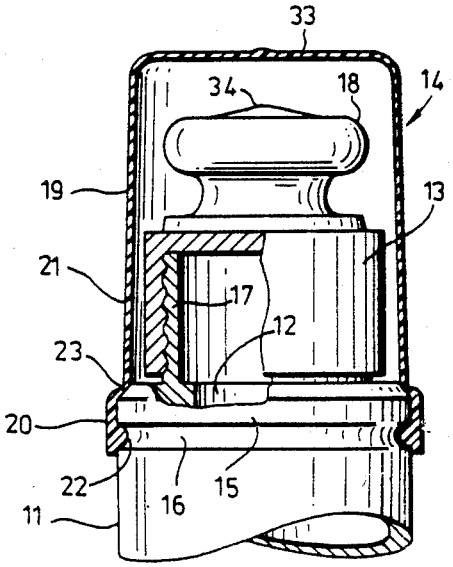
FIG. 2 is an enlarged side elevational view of the neck region of the container of FIG. 1, with the attached shroud and closure shown in cross-section.
Figure 3:
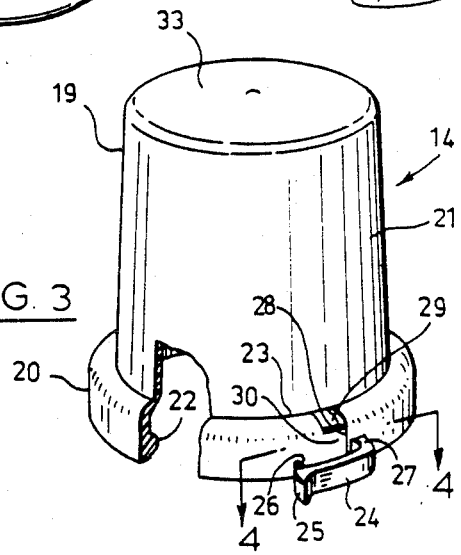
FIG. 3 is a perspective view of the shroud of FIGS. 1 and 2, partly broken away to show details of the rim portion.

The particular closure 13 shown is of a known design, featuring a pop-up squirting device or nozzle 18 used for dispensing liquids such as pancake syrup. In FIG. 2, the nozzle is shown in the lowered or closed position, wherein an upright stationary member (not shown) occludes a centrally placed aperture 34 in the nozzle 18 so as to prevent flow of the contents of the container 10 there-through. In the open position (not shown) the nozzle 18 is raised above the upper end of the stationary member, thereby clearing the aperture 34.

The body portion 19 of the shroud 14 is dimensioned so that its side wall 21 and end walls 33 are physically free of contact with the closure 13 when the shroud 14 is in place on the container 10 and the closure 13 is in the closed position described above. It is particularly desirable to dimension the clearance between the nozzle 18 and the end wall 33 so that there is insufficient spacing to allow movement of the nozzle 18 to the open position without removal of the shroud 14 from the container 10.

The shroud is moulded, as by injection moulding, in one piece of ultra high-flow low-density polyethylene resin, having a solid density of approximately 0.930 $g/cm^3$ and a grid flow number of approximately 40 cm.

One suitable resin is sold by Dupont Canada Inc. under the trade mark "SCLAIR 2316".

In the embodiment shown, a notch-line 23 of weakness is provided at the juncture of the body portion 19 and the rim portion 20. The notch-line 23 constitutes a relatively weak portion between the body portion 19 and rim portion 20 of the shroud 14. The notch-line 23 can be formed in the shroud during moulding by designing the mould so as to form a shroud having a thin wall section at the position of the notch-line 23, the thickness of this section being significantly less than the thickness of either the side wall 21 or the rim portion 20. The exact thickness of the moulding material at the notch-line 23 in a particular shroud design will vary with the resistance of the resilient rim portion 20 to being pulled back over the ridge 15 of the container 10, a particular thickness being acceptable where the body portion 19 tears away from the rim portion 20 along notch-line 23 when removal of the shroud 14 by pulling on the body portion 19 is attempted. This resistance is a function of the frictional interaction between the container ridge 15 and the ridge 22 of the rim portion 20 of the shroud 14. A typical operative thickness of the relatively weak portion at the notch-line 23 is approximately 0.012 inches, where the side wall 21 and the rim portion 20 have a thickness of approximately 0.035 inches, and the moulding material is "SCLAIR 2316" polyethylene resin. Routine trial and experiment will give other suitable thicknesses when other dimensions are utilized.

It will be apparent that access to the closure 13 by pulling the shroud 14 from the container 10 cannot be had without visibly tearing the relatively weak portion of the shroud 14 along the notch-line 23. Such tearing provides a clear indication of tampering. A tamperer may attempt to remove the closure 13 from the container without actually removing the shroud 14, as, for example, by pressing the body portion 19 inwardly to grip and turn the closure 13 off of the container 10. Such attempts may cause tearing at the notch-line 23. However, where the forces generated by squeezing of the body portion 19 are insufficient to cause tearing of the relatively weak portion at the notch-line 23, the closure 13, as it is unscrewed, will rise and push the body portion 19 upwardly, causing tearing at notch-line 23.

Upon assembly, the shroud 14 is, after heating, pushed onto the neck of the container 10 until the ridge 22, of generally circular cross-section, snaps into the groove 16, engaging the underside of ridge 15.

Two critical points of the invention must be here emphasized. First, to achieve moulding of the shroud without side action of the mould dies it is necessary that the ridge 22 have a generally circular cross-section of relatively small radius. Such a profile allows the shroud to be easily removed from the male mould die and also facilitates the gradual easing of the ridge 22 over the ridge 15. Second, as the ridge 15 of the moulded container does not, as previously discussed, itself have a sharp well-defined engagement surface, this profile of the ridge 22 provides for a "sloppy" interference fit with the ridge 15. This being so, it is necessary that there be considerable dimensional overlap between the interacting surfaces of the ridge 22 and the ridge 15 if rupturing of the notch-line 23 upon unauthorized removal of the shroud 14 is to be ensured. Such dimensional overlap can be maximized by sizing the diameter of the ridge 22 such that it tightly encircles the groove 16. However, but for the heating step more fully outlined below, such sizing of the ridge 22 will normally cause rupturing of the notch-line 23 upon initial placement of the shroud 14 on the container 10. It is, therefore, necessary to heat the shroud 14 before pushing it onto the container 10 so as to impart additional elasticity to the rim portion 20 such that the ridge 22 thereon will slide easily over the container ridge 15 without tearing or rupturing of the notch-line 23. Upon cooling, the rim portion 20, including the ridge 22, returns to its original elasticity, so as to make removal of the shroud 14 without tearing of the notch-line 23 impossible. Where the shroud 14 is constructed of "SCLAIR 2316" polyethylene material, it should be heated to between 110°-150° F. to accomplish the desired effect, with the best results being achieved at about 130° F. The heating of the shroud 14 typically takes place in an automatic capping machine (not shown) just prior to placement onto the containers.

When it is desired to remove the shroud 14 to have access to the closure 13, the rim portion 20 can be torn off circumferentially from the body portion 20 along the notch-line 23 of weakness. In this manner, the rim portion 20 constitutes a tear-off strip.

Once the rim portion 20 is removed in this manner, the cup-shaped body portion 19 that remains has a smooth edge where the shroud 14 was torn along notch-line 23, and the cup-shaped body portion 19 can be of a size suitable to contain a unit dosage of medicine or other contents from the container 10. Additionally, measurement markings may be provided on the body portion 19. Thus, the cup-shaped body portion 19 may serve the purpose of a measuring cup from which the consumer can measure a desired dosage of the container contents. Also, where the material of the cup-shaped body portion is impervious to dust, it can, after removal of the rim portion 20, be disposed over the closure 13 to serve as a dust cover.

The rim portion 20 may present several specific features to aid in peeling it from the body portion 19. These features are most clearly seen in FIGS. 3 and 4. An external flexible tab 24, having a free end 25, is, optionally, connected by a rupturable web 26 to the rim portion 20. Rupture of web 26 provides additional visual evidence of tampering. The tab 24 has a second end 27 fixed to the rim portion 20 adjacent a tranverse notch-line 28 of weakness of the rim portion 20. The inwardly protruding peripheral ridge 22 presents an interruption 29 at the notch-line 28, the interruption 29 being spanned by a rupturable membrane 30 which is a circumferential extension of the wall of the rim portion 20. The purpose of the interruption 29 is to facilitate rupture of the rim portion 20 along the notch-line 28 when the tab 24 is pulled outwardly by its free end 25. Further peeling of the tab 24 after rupturing of the membrane 30 causes the rim portion 20 to tear peripherally along the notch-line 23 of the relatively weak portion between the body portion 19 and rim portion 20. In this manner, the rim portion 20 is cleanly peeled off the body portion 19, allowing unrestricted access to the closure 13.

The presence of the interruption 29 of the ridge 22 adds to the resiliency or elasticity of the rim portion 20 when the shroud 14 is initially pushed onto the neck of the container 10. The membrane 30 is sufficiently elastic, when heated as previously discussed, to prevent its tearing or rupturing upon such initial placement of the shroud 14.

Figure 4:
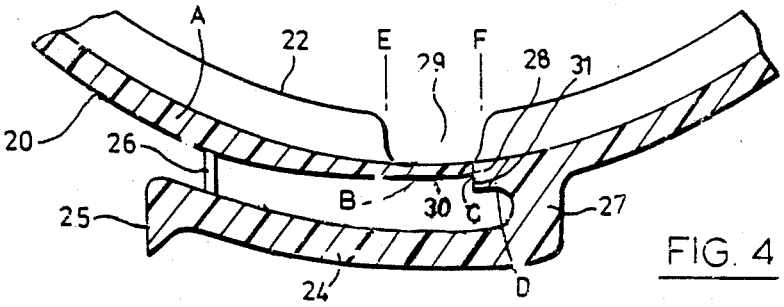
FIG. 4 is an enlarged section on line 4—4 of FIG. 3.

It has been found particularly advantageous to taper the thickness of the wall of the rim portion 20 in the region adjacent the interruption 29. More particularly, as seen in FIG. 4, the wall of the rim portion 20 gradually decreases in thickness moving from left to right across the Figure, beginning at a maximum thickness in the region adjacent web 26, and reaching a minimum thickness adjacent notch-line 28. The maximum thickness resumes abruptly on the opposite (right) side of notch-line 28, at ridge 31. In the embodiment shown by way of example, the wall of the rim portion 20 has a maximum thickness of approximately 0.035 inches at A, narrowing to approximately 0.018 inches at B, to approximately 0.015 inches at C, and widening again to approximately 0.035 inches at D. The distance between points E and F is approximately 0.125 inches. The protrusion of the peripheral ridge 22 beyond the wall of the rim portion 20 is approximately 0.060 inches. The tapering of membrane 30 and the positioning of ridge 31 adjacent the notch-line 28 helps to ensure that the rupturing of membrane 30 occurs in the direction of notch-line 28 when tab 24 is pulled outwardly.

Figure 5:
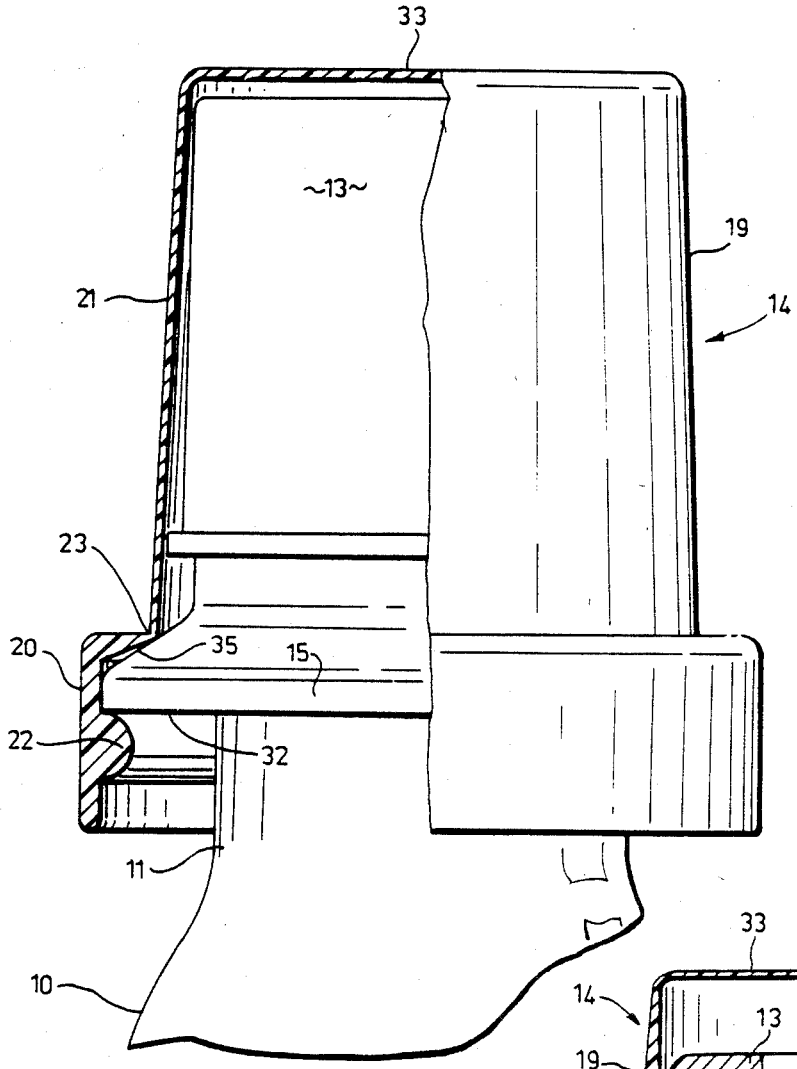
FIG. 5 is an enlarged side elevational view of a second embodiment of a container shroud according to the invention in place on the neck region of a container with the attached shroud shown in cross-section.

Another embodiment of shroud and moulded container according to the invention is shown in FIG. 5. In this embodiment, the outwardly protruding peripheral ridge 15 of container 10 protrudes beyond a smooth ungrooved neck surface 11 of the container, and provides an undersurface 32 for engagement by the ridge 22 of the rim portion 20. An upper surface 35 of ridge 15 slopes downwardly to meet undersurface 32. This sloping aids in urging ridge 22 over ridge 15 upon the initial placement of the shroud 14 on the container 10.

Figure 6:
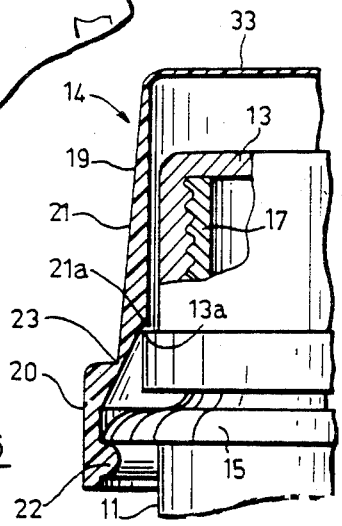
FIG. 6 is an enlarged side elevational view of a third embodiment of a container shroud according to the invention in place on the neck region of a container, with the attached shroud and closure shown in cross-section.

Another embodiment of shroud and moulded container according to the invention is shown in FIG. 6. In this embodiment, the body portion 19 of shroud 14 is held by the rim portion 20 free of contact with both the closure 13 and the container ridge 15, being supported in this position by the relatively weak portion between the body 19 and rim 20 portions, which weak portion constitutes the notch-line 23. It will be obvious that this shroud design, wherein the body portion 19 is held free of contact with both the container 10 and the closure 13, may also be used where the container neck 11 is grooved, as in FIGS. 1–4.

The body portion 19 may also have its side wall 21 interiorly thickened to form a ledge 21*a*, which, when the rim portion 20 is peeled away, will rest on a corresponding ledge 13*a* of the closure 13, so as to facilitate use of the body portion 19 as a dust cover. That is, with the rim portion 20 removed, the cup-shaped body portion 19 is able to advance further onto the container 10 than shown in FIG. 5, so that ledge 21*a* comes into contact with corresponding ledge 13*a*, thus sealing against entry of dust.

Figure 7:
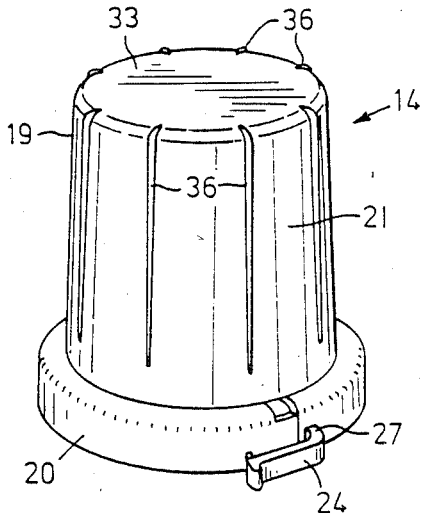
FIG. 7 is a perspective view of a fourth embodiment of a container shroud according to the invention.

Typically shrouds according to the invention, as shown in FIGS. 1–6, are randomly loaded into the hopper of an automatic container capping machine (not shown). In such machine, the shrouds 14, with the aid of vibrating means acting on the hopper, move one at a time into a thermostatically heated raceway, where they are heated, as previously discussed. The shrouds 14 drop serially from the opposite end of the raceway onto a row of containers 10 moving below. The shrouds 14 are, at a subsequent station, pressed onto the containers 10 so as to engage the ridge 15, as previously described. It has been found that where a number of the shrouds 14 are placed together in the hopper, they tend to nest together one inside the other, thereby interrupting the orderly flow of the shrouds 14 from the hopper into the raceway. To overcome this problem, it is desirable to provide a plurality of longitudinal raised ribs 36, spaced evenly around the outer surface of the side wall 21 of the body portion 19 of the shroud 14. A fourth embodiment of a container shroud incorporating these ribs 36 is shown in FIG. 7. The preferred number of such ribs is, as shown, eight, while as few as four and as many as twelve ribs 36 may be successfully utilized. The shroud 14 of FIG. 7 is in all other essential respects the same as the shrouds 14 of FIGS. 1–6. Where the shroud 14 has the dimensions previously disclosed, the ribs preferably have a maximum radial thickness of between 0.075–0.085 inches at the upper end adjacent end wall 33, tapering to a thickness of 0.0 inches towards rim portion 20. The ribs 36 are formed on the side wall 21 during the moulding process of the shroud 14.

While but four specific embodiments of the present invention are herein shown and described, it will be understood that various changes in size, shape and arrangement of parts may be made without departing from the spirit of the invention. For example, the rim portion 20 need not be outwardly stepped from the body portion 19. That is, the side wall 21 may be in line with the outer wall surface of the rim portion 20, in which case the notch-line 23 will be the only indication of the beginning of the rim portion 20.

I claim:

1. For use with a moulded plastic or glass container having a mouth with an outwardly protruding peripheral ridge and a closure for the mouth, a shroud moulded of ultra high-flow low-density polyethylene resin that can, upon heating, be pushed onto the container over the closure to encase the closure, the shroud having a cup-shaped body portion and a resilient rim portion of generally circular cross-section which can be pushed over the ridge of the container with the body portion free of contact with the closure located within the shroud, the shroud having a relatively weak portion between its body and its rim portions, the resistance of the weak portion to tearing being less than the resistance of the rim portion to being pulled, after cooling, back over the ridge of the container whereby access to the closure cannot be had without visibly tearing the weak portion of the shroud.

2. A shroud according to claim 1 wherein the rim portion is outwardly stepped from the cup-shaped body portion and said weak portion is located at the juncture of said rim portion and said cup-shaped body portion.

3. A shroud according to claim 2 wherein the body portion is free of contact with both the container and the closure when the shroud is pushed onto the container.

4. A shroud according to claim 2 wherein the rim portion has an external flexible tab having a free end connected by a rupturable web to the rim portion, the tab having an end fixed to the rim portion adjacent a transverse notch-line

5. A shroud according to claim 1 wherein the shroud is heated to approximately 110° F. before it is pushed onto the container. of weakness of the rim portion, the inwardly protruding peripheral ridge of the rim portion being interrupted at said transverse notch-line to facilitate rupture of the rim portion along said notch-line when the tab is pulled to peel the rim portion off the cup-shaped body portion.

6. A shroud according to claim 1 wherein the body portion is provided on its outer surface with a plurality of evenly spaced longitudinal ribs.

7. A shroud according to claim 6 wherein eight of said ribs are provided.

8. In combination, a moulded plastic or glass container having a mouth with an outwardly protruding peripheral ridge, a closure for the mouth, and a shroud moulded of ultra high-flow low-density polyethylene resin, having a cup-shaped body portion within which the closure is encased, the shroud having a rim portion having an inwardly protruding peripheral ridge of generally circular cross-section extending under the ridge of the container so as to hold the shroud on the container, the cup-shaped body portion being free of contact with the closure, the shroud being moulded of ultra high-flow low-density polyethylene resin with a notch-line of weakness between the rim portion and the cup-shaped body portion, the resistance of the line of weakness to tearing being less than the resistance of the ridge of the rim portion to being pulled over the ridge of the container if the cup-shaped body portion is pulled to expose the closure whereby access of the closure cannot be had without visibly tearing the shroud at the notch-line of weakness thereby providing evidence of tampering, the rim portion also constituting a tear-off strip that can be peeled off the cup-shaped body portion along the line of weakness whereby the cup-shaped body portion can serve as a measuring cup.

9. The combination of claim 8, wherein the rim portion is outwardly stepped from the cup-shaped body portion and said notch-line of weakness is located at the juncture of said rim portion and said cup-shaped body portion.

10. The combination of claim 9 wherein the shroud is held on the container with the cup-shaped body portion free of contact with both the closure and the container.

11. The combination of claim 10 wherein the rim portion has an external flexible tab having a free end connected by a rupturable web to the rim portion, the tab having an end fixed to the rim portion adjacent a transverse notch-line of weakness of the rim portion, the inwardly protruding peripheral ridge of the rim portion being interrupted at said transverse notch-line to facilitate rupture of the rim portion along said line when the tab is pulled to peel the rim portion off the cup-shaped body portion.

12. The combination of claim 11, wherein the cup-shaped body portion is impervious to dust and with the rim portion removed can be disposed over the closure to serve as a dust cover.

13. The combination of claim 9, wherein the rim portion has an external flexible tab having a free end connected by a rupturable web to the rim portion, the tab having an end fixed to the rim portion adjacent a transverse notch-line of weakness of the rim portion, the inwardly protruding peripheral ridge of the rim portion being interrupted at said transverse notch-line to facilitate rupture of the rim portion along said line when the tab is pulled to peel the rim portion off the cup-shaped body portion.

14. The combination of claim 13, wherein the cup-shaped body portion is impervious to dust and with the rim portion removed can be disposed over the closure to serve as a dust cover.

15. The combination of claim 8, wherein the shroud is held on the container with the cup-shaped body portion free of contact with both the closure and the container.

16. The combination of claim 8 wherein the rim portion has an external flexible tab having a free end connected by a rupturable web to the rim portion, the tab having an end fixed to the rim portion adjacent a transverse notch-line of weakness of the rim portion, the inwardly protruding peripheral ridge of the rim portion being interrupted at said transverse notch-line to facilitate rupture of the rim portion along said line when the tab is pulled to peel the rim portion off the cup-shaped body portion.

17. The combination of claim 8, wherein the cup-shaped body portion is impervious to dust and with the rim portion removed can be disposed over the closure to serve as a dust cover.

18. The combination of claim 8 wherein the body portion of the shroud is provided on its outer surface with a plurality of evenly spaced longitudinal ribs.

19. The combination of claim 18 wherein eight of said ribs are provided.

* * * * *